US007833137B2

(12) United States Patent
Garnuette

(10) Patent No.: US 7,833,137 B2
(45) Date of Patent: Nov. 16, 2010

(54) EXERCISE SYSTEM

(76) Inventor: Shawn Garnuette, 970 Hutton St., Winston Salem, NC (US) 27101

( * ) Notice: Subject to any disclaimer, the term of this patent is extended or adjusted under 35 U.S.C. 154(b) by 0 days.

(21) Appl. No.: 12/389,064

(22) Filed: Feb. 19, 2009

(65) Prior Publication Data

US 2010/0210428 A1 Aug. 19, 2010

(51) Int. Cl.
*A63B 21/065* (2006.01)
*A63B 23/10* (2006.01)
*A43B 5/00* (2006.01)

(52) U.S. Cl. ..... 482/79; 482/105; 36/132

(58) Field of Classification Search ..... 482/51, 482/74, 79, 92, 93, 105, 139, 148; 36/132, 36/136; 2/245; D21/683
See application file for complete search history.

(56) References Cited

U.S. PATENT DOCUMENTS 4,372,060 A * 2/1983 Adamik ..... 36/54
4,382,302 A * 5/1983 Watson ..... 2/102
4,384,414 A 5/1983 Gamm
4,632,389 A * 12/1986 Moss ..... 482/105
4,805,321 A * 2/1989 Tonkel ..... 36/54
4,911,433 A * 3/1990 Walker et al. ..... 482/105
4,989,267 A * 2/1991 Watson ..... 2/102
4,999,888 A * 3/1991 Miller ..... 24/712.3
5,042,119 A * 8/1991 Williams ..... 24/712.3
5,094,016 A * 3/1992 DiVito ..... 36/136
5,162,032 A 11/1992 Dohner
5,311,679 A * 5/1994 Birch, Sr. ..... 36/136
5,632,709 A 5/1997 Walsh
6,010,438 A * 1/2000 Fitzgerald ..... 482/105
6,449,881 B1 * 9/2002 Assaf et al. ..... 36/136
6,742,288 B2 * 6/2004 Choi ..... 36/132
7,000,337 B2 * 2/2006 Harrington ..... 36/132
2003/0126768 A1 * 7/2003 Hutt ..... 36/136

FOREIGN PATENT DOCUMENTS

DE 3532512 A1 * 3/1987
GB 2139103 A * 11/1984

* cited by examiner

*Primary Examiner*—Loan Thanh
*Assistant Examiner*—Victor K Hwang
(74) *Attorney, Agent, or Firm*—Dale J. Ream

(57) ABSTRACT

An exercise system includes a flexible attachment member sized for positioning between a shoe's tongue and laces that extends beneath a majority of the laces. The attachment member includes opposed first and second faces, the first face having hook and loop coupling elements of a first configuration, the second face having hook and loop coupling elements of a second configuration. The exercise system includes a plurality of weight members, each having a first face with hook and loop coupling elements of the first configuration and a second face with hook and loop coupling elements of the second configuration. The hook and loop coupling elements of the first and second configurations are complementary to one another to couple at least one weight members to the attachment member first or second face and couple at least one the weight members atop a respective weight member coupled to the attachment member.

14 Claims, 9 Drawing Sheets

EXERCISE SYSTEM

BACKGROUND OF THE INVENTION

This invention relates generally to exercise devices and, more particularly, to an exercise system that includes weight devices attachable to a shoe for providing physiological benefits to a wearer of the augmented shoe.

Individuals desiring to strengthen and train the muscles in their ankles and legs may engage in weight training using a weight system in a gym or home. If, however, the desire is for aerobic exercise, the person may engage in running, jogging, or other sports. Despite the efficacy of each of these training regimens, a person desiring both results may find it difficult to find the time to participate in both weight training and aerobic exercise.

Various devices have been proposed in the art for attaching weights to shoes in order to provide weight exercise to a person's legs both during athletic training or just casual activity. Although assembly effective for their intended purposes, the existing devices or proposals either require attachment in a way that actually inhibits normal walking/running or do not provide means for quickly and removably anchoring an attachment member to the shoe and attaching varying weights and quantities of weight members to the attachment strip.

Therefore, it would be desirable for a person to obtain physiological benefits by exercising and performing everyday tasks with weighted footwear. Further, it would be desirable to have an exercise system of weight training that attaches to athletic shoes. In addition, it would be desirable to have an exercise system that enables a variable amount of weight to be attached or removed easily and quickly.

SUMMARY OF THE INVENTION

An exercise system according to a preferred embodiment of this invention includes an elongate flexible attachment member sized for positioning between a shoe's tongue and laces that extends beneath at least a majority of the laces. The attachment member includes opposed first and second faces, the first face having hook and loop coupling elements of a first configuration, the second face having hook and loop coupling elements of a second configuration. The exercise system includes a plurality of weight members, each having a first face with hook and loop coupling elements of the first configuration and a second face with hook and loop coupling elements of the second configuration. The hook and loop coupling elements of the first and second configurations are complementary to one another to couple at least one weight members to the attachment member first or second face and couple at least one the weight members atop a respective weight member coupled to the attachment member.

Therefore, a general object of this invention is to provide an exercise system that gives weight training to the muscle groups of a person's legs by enabling weights to be attached to a shoe.

Another object of this invention is to provide an exercise system, as aforesaid, that enables varying amounts of weights to be secured to each other and to the shoe for progressive weight training.

Still another object of this invention is to provide an exercise system, as aforesaid, having an attaching strip securable beneath the laces of a shoe to which weight members may be anchored with complementary hook and loop fasteners.

A further object of this invention is to provide an exercise system, as aforesaid, that is easy to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An exercise system will now be described in detail with reference to FIG. 1 through FIG. 5*c* of the accompanying drawings. More particularly, an exercise system 100 includes an elongate flexible attachment member 110 and a plurality of weight members 120.

Figure 2:
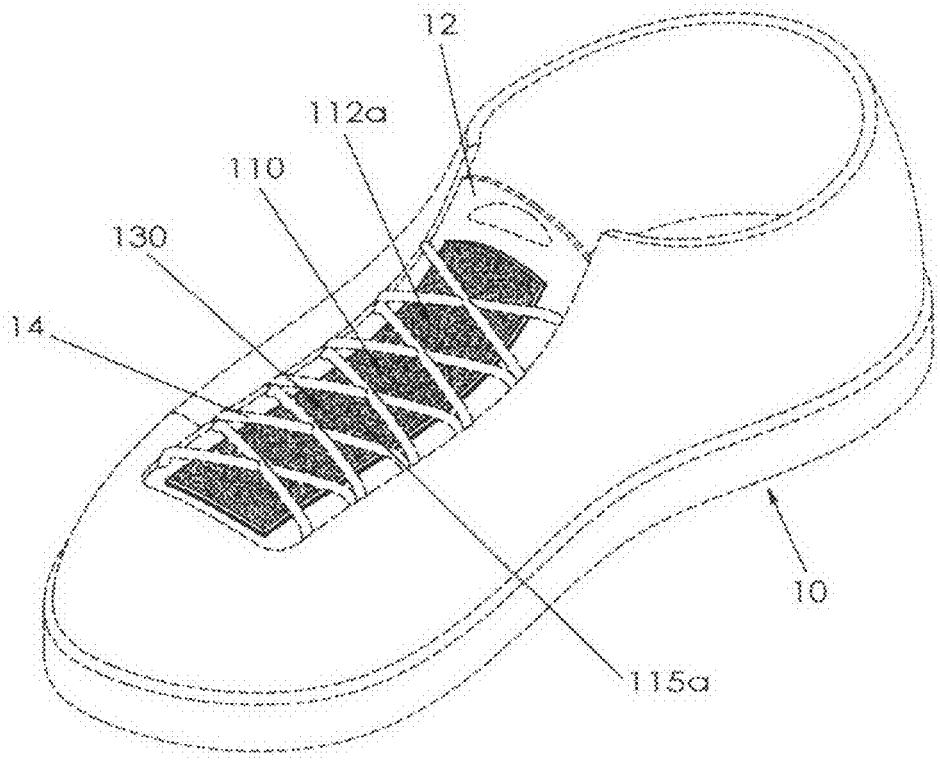
FIG. 2 is a perspective view of the exercise system as in FIG. 1 with the weight members removed.
Figure 3A:
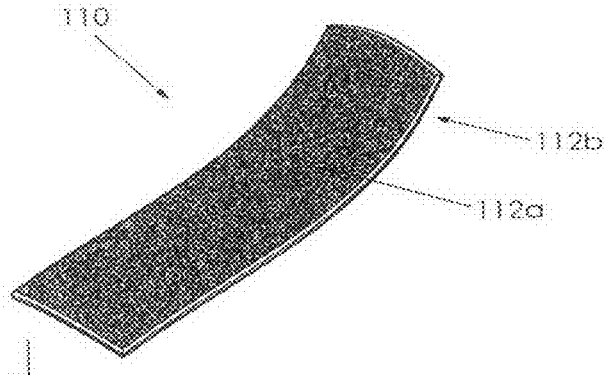
FIG. 3*a* is a perspective view of an attachment removed from the shoe.
Figure 3B:
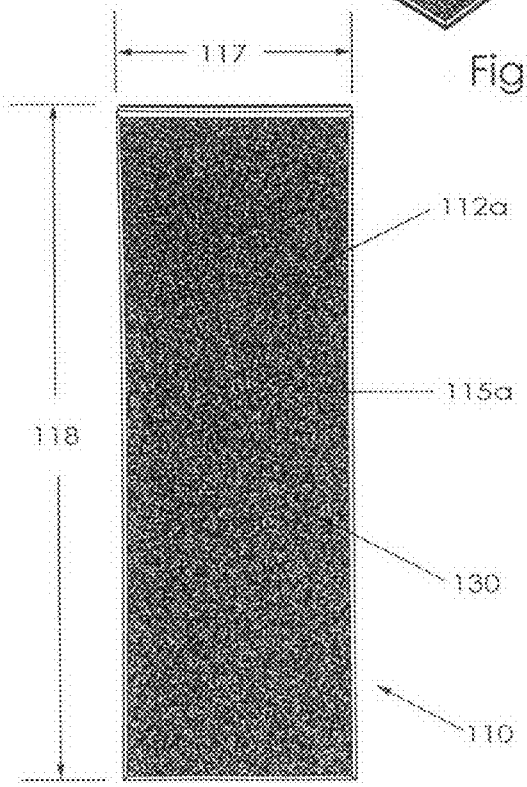
FIG. 3*b* is a top view of the attachment member as in FIG. 3*a;*
Figure 3C:
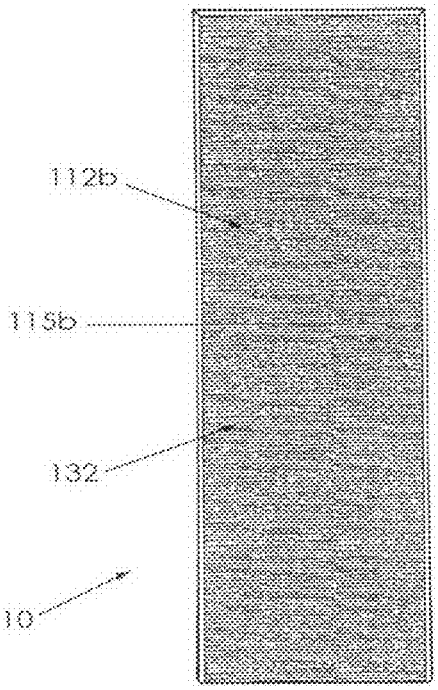
FIG. 3*c* is a bottom view of the attachment member as in FIG. 3*a;*

As shown in FIG. 2, the attachment member 110 is sized for positioning between a tongue 12 and laces 14 of a shoe 10 and extending beneath at least a majority of the laces 14. The attachment member 110 has opposed first and second faces 112*a*, 112*b* (FIGS. 3*a* through 3*c*), and the first face 112*a* has hook and loop coupling elements 115*a* of a first configuration 130. The second face 112*b* (FIG. 3*c*) has hook and loop coupling elements 115*b* of a second configuration 132. As shown in FIG. 2, the attachment member 110 may be coupled to the shoe 10 solely by being sandwiched between the shoe's tongue 12 and laces 14.

Figure 4A:
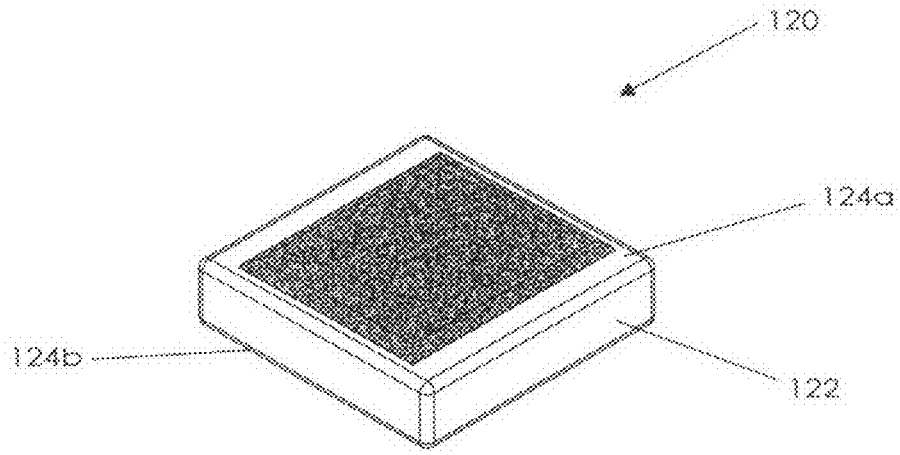
FIG. 4*a* is a perspective view of a weight member as in FIG. 1.
Figure 4B:
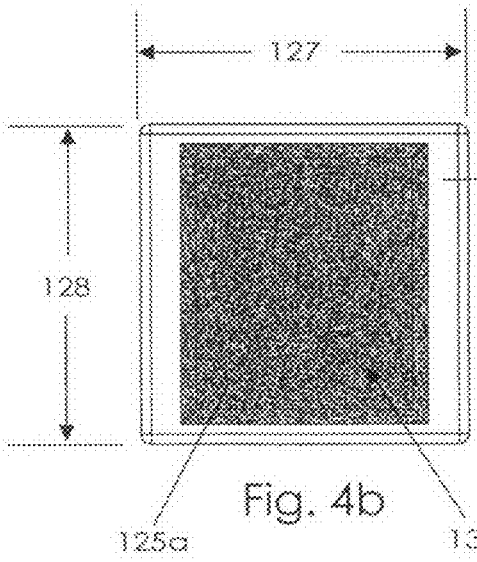
FIG. 4*b* is a top view of the weight member as in FIG. 4*a;*
Figure 4C:
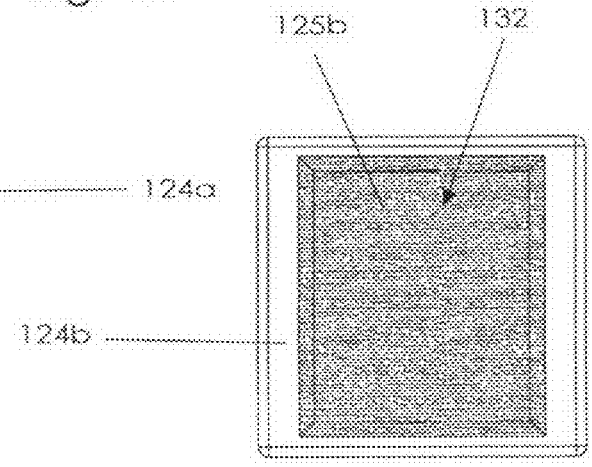
FIG. 4*c* is a bottom view of the weight member as in FIG. 4*a;*

Each weight member 120 has a load portion 122 between opposed first and second faces 124*a*, 124*b*, as shown in FIGS. 4*a* through 4*c*. The load portion 122 may include any appropriate material, such as lead covered by plastic, rubber, and/or paint. It may be preferable to use a material that provides a relatively large amount of mass per volume (e.g., a material having a density of about 10 g/mL or greater). Each weight member first face 124*a* (FIG. 4*b*) has hook and loop coupling elements 125*a* of the first configuration 130, and each weight member second face 124*b* (FIG. 4*c*) has hook and loop coupling elements 125*b* of the second configuration 132. The hook and loop coupling elements 125*a* of the first configuration 130 may substantially cover each weight member first face 124*a*, and the hook and loop coupling elements 125*b* of the second configuration 132 may substantially cover each weight member second face 124*b*, as shown in FIGS. 4*b* and 4*c*.

Figure 1:
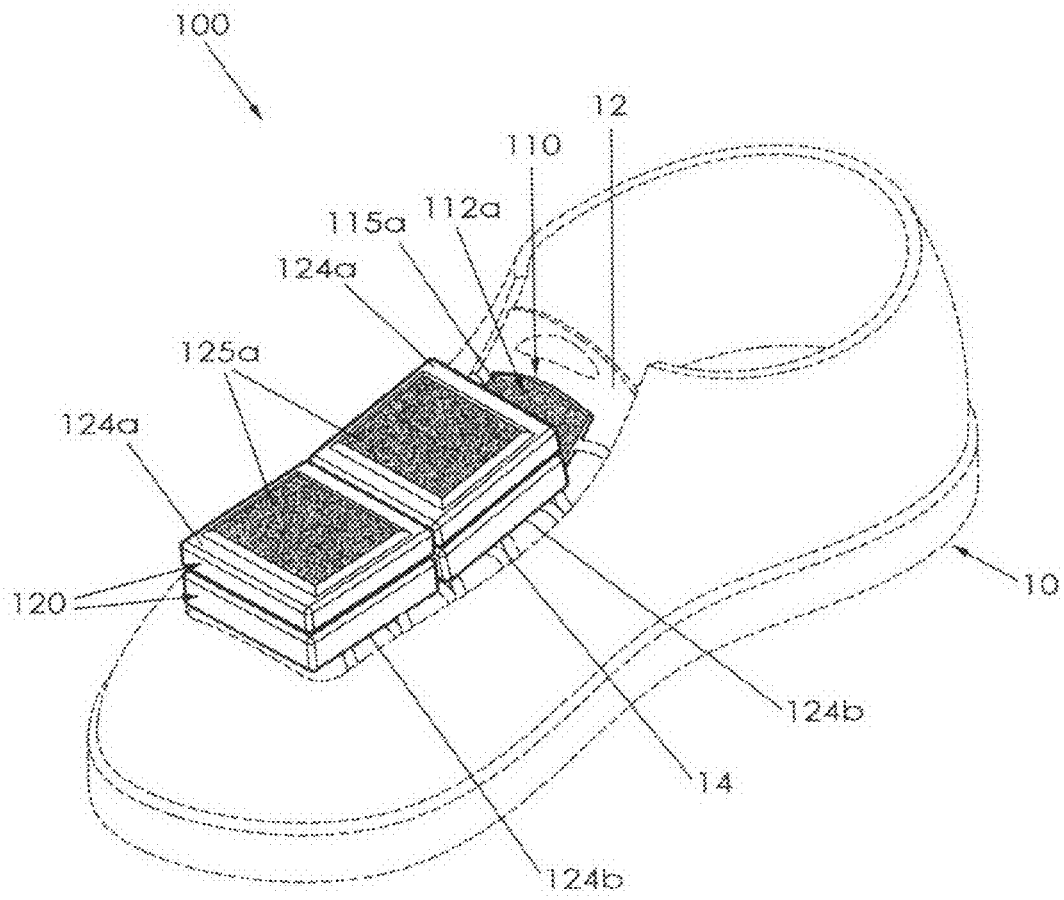
FIG. 1 is a perspective view of an exercise system in use with a shoe according to a preferred embodiment of the present invention.

The hook and loop coupling elements 115*a*, 125*a* of the first configuration 130 are complementary to the hook and loop coupling elements 115*b*, 125*b* of the second configuration 132 to couple at least one weight member 120 to the attachment member 110 (i.e., at the first face 112*a* or the second face 112*b*) and couple at least one weight member 120 atop a respective weight member 120 coupled to the attachment member 110, as shown in FIG. 1. The weight members 120 may each have a width 127 (FIG. 4*b*) that is substantially equal to or less than a width 117 of the attachment member 110 (FIG. 3*b*) so that the weight members 120 do not substantially overlap the attachment member 110 when coupled to the attachment member 110 (FIG. 1). Further, the weight members 120 may each have a length 128 (FIG. 4*b*) that is less than one half of a length 118 of the attachment member 110 (FIG. 3*b*) so that the weight members 120 directly coupled to the attachment member 110 (i.e., by interaction between the hook and loop coupling elements of the first and second configurations 130, 132) may be spaced apart from one another (FIG. 1) to avoid interference between the weight members 120 when the shoe 10 flexes (e.g., during walking or running).

Figure 5A:
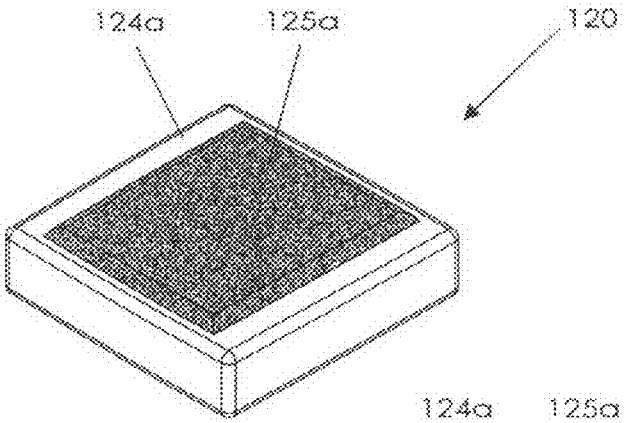
FIGS. 5*a*-5*c* are perspective view of weight members of varying sizes.
Figure 5B:
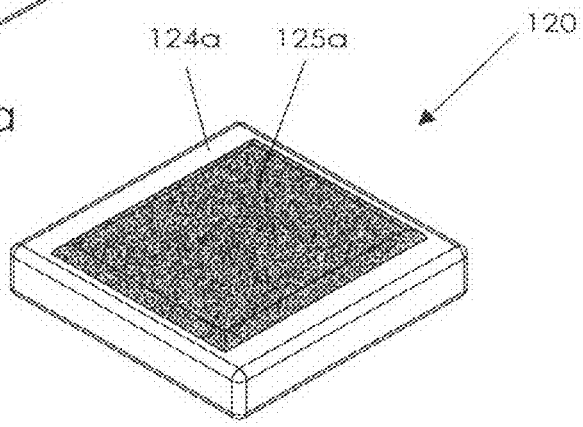
Figure 5C:
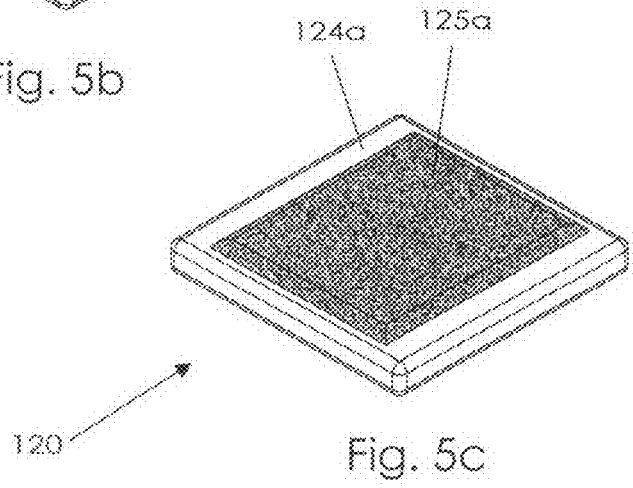

In some embodiments, each weight member 120 may be substantially similar to each other weight member 120, while in other embodiments the weight members 120 differ between one another (FIGS. 5*a* through 5*c*). For example, at least one weight member 120 may have a different weight from at least one other weight member 120. While various configurations may clearly be acceptable for the weight members 120, a weight member 120 of one configuration has a width 127 of approximately two inches, a length 128 of approximately two inches, and a distance between the first and second weight member faces 124*a*, 124*b* of approximately one half inch.

In use, the attachment member 110 may be placed between the tongue 12 and laces 14 of the shoe 10, as shown in FIG. 2. If the second face 112*b* includes the hook and loop coupling elements 115*b*, either the first face 112*a* or the second face 112*b* may be positioned to face upward (i.e., toward the laces 14); if not, the first face 112*a* must be positioned to face upward. Either before or after the user places the shoe 10 on his foot, the weight member(s) 120 may be coupled to the attachment member 110. Depending on the amount of weight desired, more or fewer weight members 120 may be used, and the weight members 120 may be located at different places along the attachment member 110 to target different muscles.

To couple the weight member(s) 120 to the attachment member 110, the second face 124*b* of at least one weight member 120 is placed downwardly so that the hook and loop coupling elements 125*b* may interact with the hook and loop coupling elements 115*a* if the first face 112*a* of the attachment member 110 is facing upward, as shown in FIG. 1. At least one other weight member 120 may be spaced apart from the weight member 120 already coupled to the attachment member 110 and may itself be coupled to the attachment member 110 in a similar manner (FIG. 1). As set forth above, this spacing may prevent interference between the weight members 120 when the shoe 10 flexes. To increase the amount of weight, weight members 120 may be stacked atop the weight members 120 that are directly coupled to the attachment member 110, and these upper weight members 120 may be placed with their respective second faces 124*b* facing downward so that the hook and loop coupling elements 125*b* may interact with the hook and loop coupling elements 125*a* of the lower weight members 120 (FIG. 1). The weight members 120 may be coupled to the attachment member 110 and the other weight members 120 solely by interaction between the hook and loop coupling elements 115*a*, 125*b*, 125*a*, as described. This may allow weight members 120 to quickly and easily be added or removed and also prevent the weight members 120 from undesirably separating from the attachment member 110.

If the second face 112*b* of the attachment member 110 is instead facing upward, the first face 124*a* of at least one weight member 120 is placed downwardly so that the hook and loop coupling elements 125*a* may interact with the hook and loop coupling elements 115*b*, and the upper weight members 120 may be placed with their respective first faces 124*a* facing downward so that the hook and loop coupling elements 125*a* may interact with the hook and loop coupling elements 125*b* of the lower weight members 120. As such, the weight members 120 may be coupled to the attachment member 110 and the other weight members 120 solely by interaction between the hook and loop coupling elements 115*b*, 125*a*, 125*b*.

Figure 6:
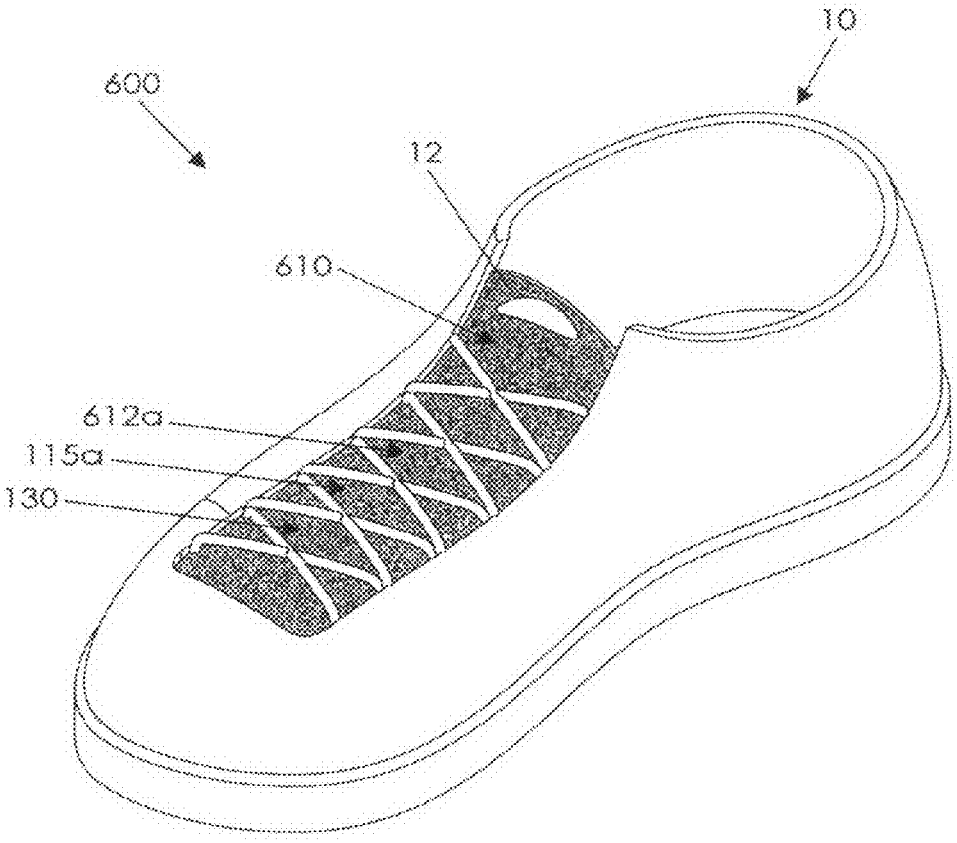
FIG. 6 is an exercise system according to another embodiment of the present invention.

FIG. 6 shows another embodiment of the disclosed exercise system. Referring to the figure, an exercise system 600 is generally similar to the exercise system 100, except for as set forth herein, shown in the drawings, and/or inherent. Elements of the exercise system 600 that are specifically discussed as being different from those of the exercise system 100 may have reference numbers between 600 and 699; common elements/features may be referred to herein and in the drawing by the same reference numbers set forth above.

The exercise system 600 differs from the exercise system 100 in one main way. Instead of including the attachment member 110, the shoe tongue 12 includes an attachment member 610. The attachment member 610 has an upper face 612*a* having hook and loop coupling elements 115*a* of the first configuration 130 and is the functional equivalent of the first face 112*a* in the exercise system 100; the weight members 120 may be coupled to the upper face 612*a* in the same manner as the weight members 120 are coupled to the first face 112*a* (set forth above).

Figure 7:
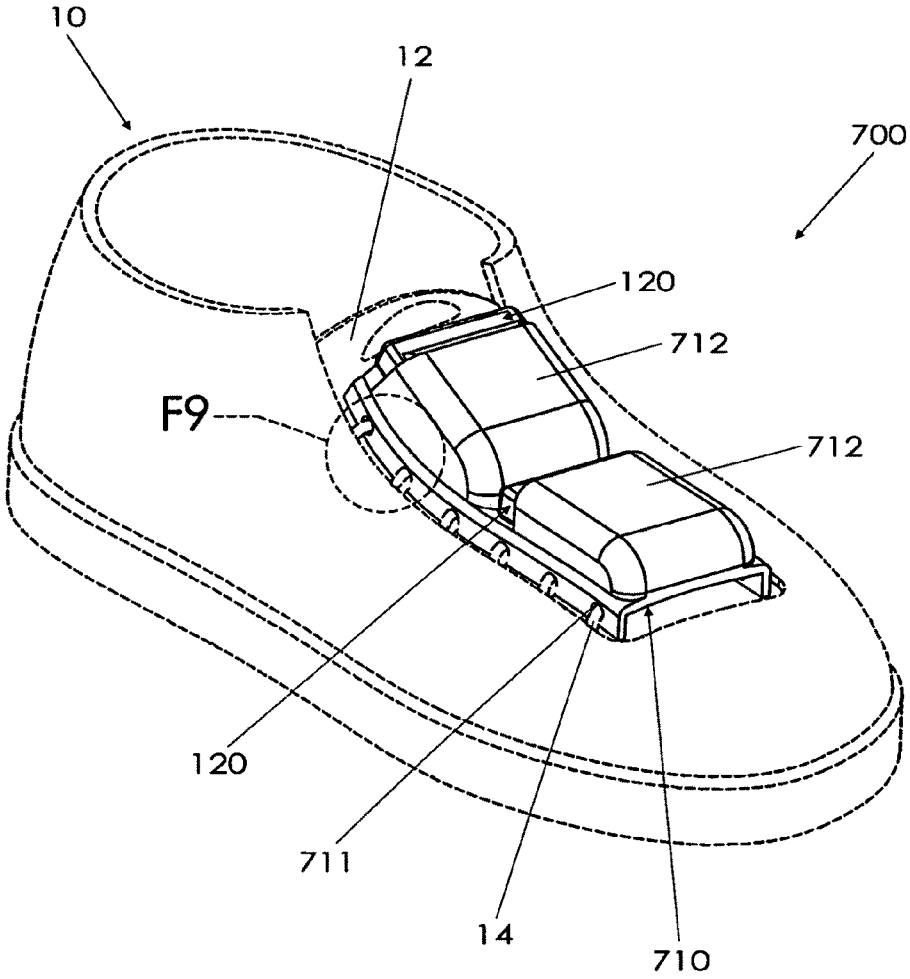
FIG. 7 is a perspective view of an exercise system according to still another embodiment of the present invention.
Figure 8A:
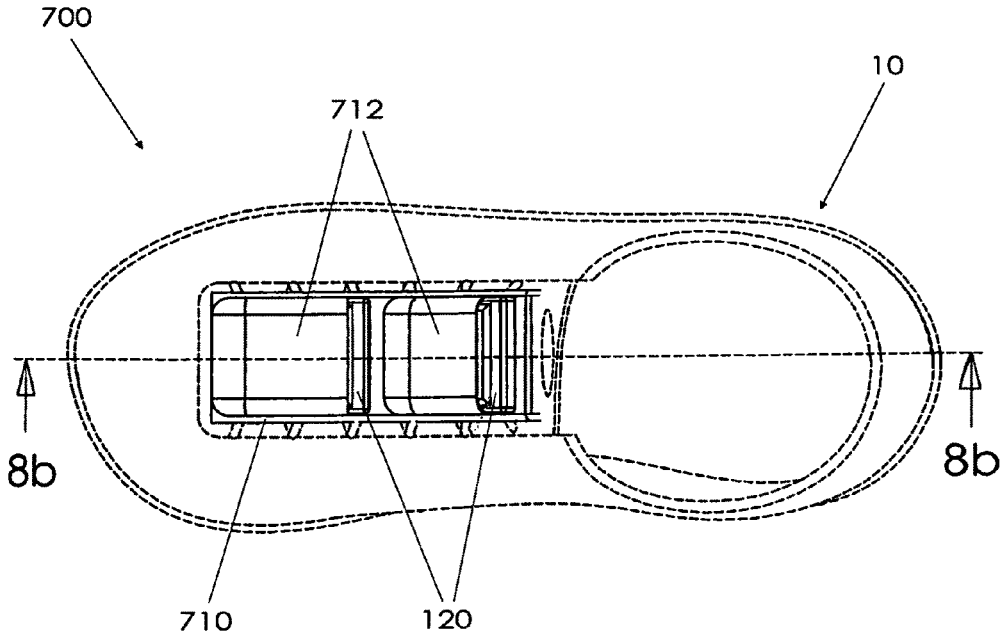
FIG. 8*a* is a top view of the exercise system as in FIG. 7.
Figure 8B:
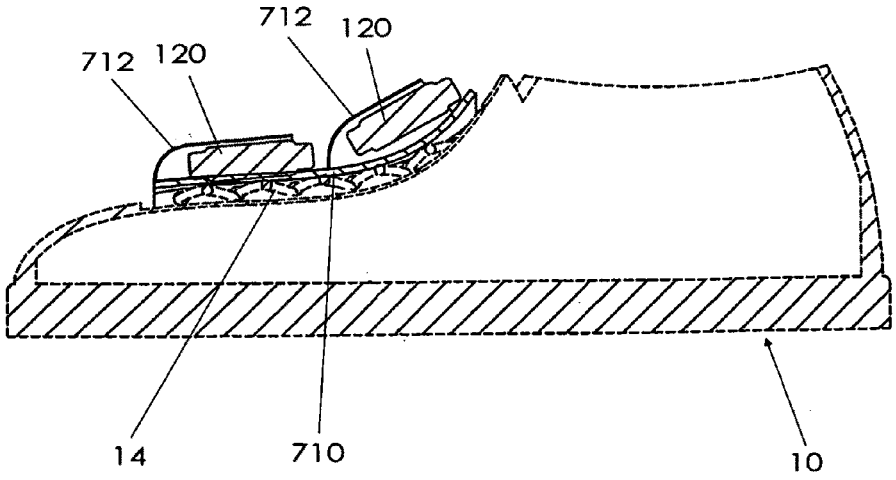
FIG. 8*b* is a sectional view taken along line 8*b*-8*b* of FIG. 8*a*.
Figure 9:
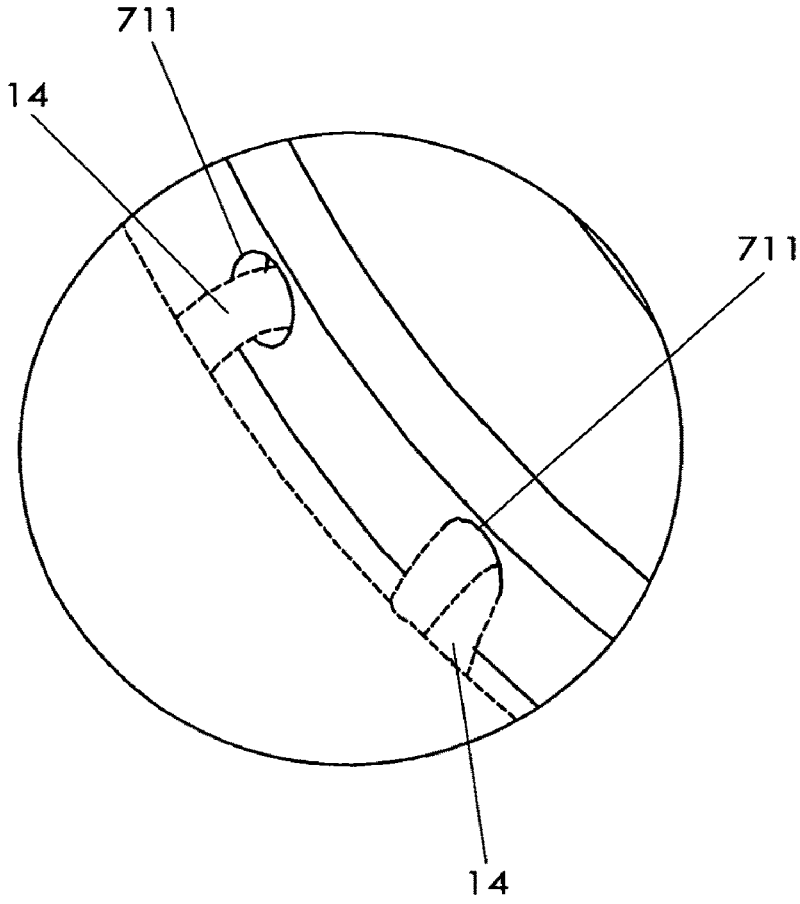
FIG. 9 is an isolated view on an enlarged scale taken from FIG. 8*b*.

FIGS. 7-9 show another embodiment of the disclosed exercise system. Referring to the figures, an exercise system 700 is generally similar to the exercise system 100, except for as set forth herein, shown in the drawings, and/or inherent. Elements of the exercise system 700 that are specifically discussed as being different from those of the exercise system 100 may have reference numbers between 700 and 799; common elements/features may be referred to herein and in the drawing by the same reference numbers set forth above.

In the exercise system 700, the attachment member 110 is replaced by an elongate attachment member 710 that is positioned adjacent the shoe laces 14. The attachment member 710 includes at least one hole 711 to receive the shoe laces 14 to couple the attachment member 710 to the shoe laces 14, as shown in FIGS. 7 and 9. In addition, instead of selectively coupling the weight members 120 to the attachment member 110 with hook and loop fasteners (as set forth above), the weight members 120 are selectively coupled to the attachment member 710 upwardly adjacent the shoe laces 14 by pockets 712 configured to receive the weight members 120. The pockets 712 extend from the attachment member 710. As shown in FIGS. 8*a* and 8*b*, the pockets 712 may be spaced apart from one another to avoid interference between the weight members 120 when the shoe 10 flexes.

In use, the attachment member 710 may be coupled to the shoe laces 14 by passing the laces 14 through the hole(s) 711. To couple the weight member(s) 120 to the attachment member 710, the weight members 120 may be placed in the pocket(s) 712.

It is understood that while certain forms of this invention have been illustrated and described, it is not limited thereto except insofar as such limitations are included in the following claims and allowable functional equivalents thereof.

The invention claimed is:

1. An exercise system, comprising:

a shoe having a tongue and laces;

an elongate flexible attachment member sized for positioning between said shoe's tongue and laces and extending beneath at least a majority of said laces, said attachment member having opposed first and second faces, said attachment member first face having hook and loop coupling elements of a first configuration, said attachment member second face having hook and loop coupling elements of a second configuration;

a plurality of weight members, each having a first face with hook and loop coupling elements of said first configuration, each having a second face with hook and loop coupling elements of said second configuration, said hook and loop coupling elements of said first configuration being complementary to said hook and loop coupling elements of said second configuration to couple at least one said weight member to said attachment member first face or second face and couple at least one said weight member atop a respective weight member coupled to said attachment member;

wherein:

said elongate attachment member is positioned on said shoe solely by being sandwiched between said shoe's tongue and laces; and said weight members are coupled to said attachment member and other said weight members solely by interaction between said hook and loop coupling elements.

2. The exercise system of claim 1, wherein:

each said weight member is substantially similar to each other said weight member;

said attachment member has a width and a length;

each said weight member has a width that is not greater than said attachment member width;

each said weight member has a length that is less than one half of said attachment member length.

3. The exercise system of claim 2, wherein each said weight member includes a load portion between said first and second weight member faces, said load portion comprising lead covered by at least one of a plastic, a rubber, or a paint.

4. The exercise system of claim 3, wherein each said weight member has a width of approximately two inches, a length of approximately two inches, and a distance between said first and second weight member faces of approximately one half inch.

5. The exercise system of claim 1, wherein:

at least two said weight members are directly coupled to said attachment member by interaction between said hook and loop coupling elements of said attachment member and said weight members;

said at least two weight members directly coupled to said attachment member are spaced apart from one another to avoid interference between said weight members when said shoe flexes.

6. The exercise system of claim 5, wherein:

said hook and loop coupling elements of said first configuration substantially cover each said weight member first face; and said hook and loop coupling elements of said second configuration substantially cover each said weight member second face.

7. An exercise system, comprising:

a shoe having a tongue and laces;

an elongate flexible attachment member sized for positioning between said shoe's tongue and laces and extending beneath at least a majority of said laces, said attachment member having opposed first and second faces, said attachment member first face having hook and loop coupling elements of a first configuration; and a plurality of weight members, each having a load portion between opposed first and second faces, each weight member first face having hook and loop coupling elements of said first configuration, each weight member second face having hook and loop coupling elements of a second configuration, said hook and loop coupling elements of said first configuration being complementary to said hook and loop coupling elements of said second configuration to couple at least one said weight member to said attachment member first face and couple at least one said weight member atop a respective weight member coupled to said attachment member;

wherein:

said elongate attachment member is positioned on said shoe solely by being sandwiched between said shoe's tongue and laces;

said weight members are coupled to said attachment member and other said weight members solely by interaction between said hook and loop coupling elements.

8. The exercise system of claim 7, wherein:

at least two said weight members are directly coupled to said attachment member by interaction between said hook and loop coupling elements of said attachment member and said weight members;

said at least two weight members directly coupled to said attachment member are spaced apart from one another to avoid interference between said weight members when said shoe flexes.

9. The exercise system of claim 8, wherein:

said hook and loop coupling elements of said first configuration substantially cover each said weight member first face; and said hook and loop coupling elements of said second configuration substantially cover each said weight member second face.

10. The exercise system of claim 9, wherein said load portion comprises lead covered by at least one of a plastic, a rubber, or a paint.

11. The exercise system of claim 9, wherein each said weight member is substantially similar to each other said weight member.

12. The exercise system of claim 9, wherein at least one said weight member has a different weight from at least one other said weight member.

13. An exercise system, comprising:

an elongate flexible attachment member adjacent laces of a shoe;

a plurality of weight members; and means for selectively coupling said weight members to said attachment member upwardly adjacent said shoe laces;

wherein:

a tongue of said shoe comprises said attachment member;

said attachment member extends beneath at least a majority of said laces;

said attachment member has an upper face;

each said weight member has a load portion between opposed first and second faces;

said means for selectively coupling said weight members to said attachment member upwardly adjacent said shoe laces includes:

hook and loop coupling elements of a first configuration at said attachment member upper face;

hook and loop coupling elements of said first configuration at each weight member first face; and hook and loop coupling elements of a second configuration at each weight member second face, said hook and loop coupling elements of said first configuration being complementary to said hook and loop coupling elements of said second configuration to couple at least one said weight member to said attachment member upper face and couple at least one said weight member atop a respective weight member coupled to said attachment member.

14. The exercise system of claim 13, wherein:

said hook and loop coupling elements of said first configuration substantially cover each said weight member first face; and said hook and loop coupling elements of said second configuration substantially cover each said weight member second face.

* * * * *